US006437294B2

(12) United States Patent
Allera et al.

(10) Patent No.: US 6,437,294 B2
(45) Date of Patent: Aug. 20, 2002

(54) PYROLYTIC SELF-CLEANING OVEN

(75) Inventors: Riccardo Allera, Laveno Monbello; Maurizio Beghi, Daverio; Adriano Scaburri, Somma Lombardo; Andrea Corda, Luino, all of (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/873,630

(22) Filed: Jun. 4, 2001

(30) Foreign Application Priority Data

Jun. 2, 2000 (EP) ..... 00112054

(51) Int. Cl.[7] ..... A21B 1/02

(52) U.S. Cl. ..... 219/413; 219/396; 219/497; 219/393; 219/395; 219/490

(58) Field of Search ..... 219/413, 396, 219/391, 393, 395, 397, 398, 412, 497, 490

(56) References Cited

U.S. PATENT DOCUMENTS

| | | | | | |
|---|---|---|---|---|---|
| 2,900,483 | A | * | 8/1959 | Welch | 392/491 |
| 3,553,425 | A | * | 1/1971 | Fry | 219/393 |
| 3,569,670 | A | * | 3/1971 | Eff | 219/413 |
| 3,785,778 | A | * | 1/1974 | Burstein et al. | 23/288 |
| 3,962,561 | A | * | 6/1976 | Maitenaz | 219/391 |
| 4,039,292 | A | * | 8/1977 | Morini et al. | 23/288 |
| 4,163,894 | A | * | 8/1979 | Scherer | 219/391 |
| 4,547,642 | A | * | 10/1985 | Smith | 219/10.55 B |
| 4,852,544 | A | | 8/1989 | Williams et al. | 126/39 |
| 5,571,433 | A | | 11/1996 | Baker | 219/413 |
| 5,738,081 | A | * | 4/1998 | Puricelli | 126/21 A |
| 6,058,924 | A | * | 5/2000 | Pool, III et al. | 126/21 A |

FOREIGN PATENT DOCUMENTS

| | | | |
|---|---|---|---|
| DE | 4139904 A | 6/1993 | F24C/14/00 |
| DE | 19606571 A | 8/1997 | H05B/1/02 |
| EP | 0831277 A | 3/1998 | F24C/14/02 |
| EP | 0878667 A | 11/1998 | F24C/14/02 |
| GB | 2325299 | 11/1998 | F24C/14/02 |

* cited by examiner

*Primary Examiner*—Teresa Walberg
*Assistant Examiner*—Shawntina T. Fuqua
(74) *Attorney, Agent, or Firm*—Joel M. Van Winkle; Robert O. Rice; Stephen Krefman

(57) ABSTRACT

A pyrolytic self-cleaning oven having a catalytic composition positioned in the oven cavity or exhaust gas passage in order to complete the combustion and/or the oxidation of gases produced by a process carried out inside the oven. The catalytic composition is supported by a ceramic coating on a metal wire. The metal wire is electrically connected to a control system of the oven for controlling the cooking and/or pyrolytic cleaning process. The catalytic composition carried on the metal wire may be part of a net-shaped catalytic element.

20 Claims, 3 Drawing Sheets

PYROLYTIC SELF-CLEANING OVEN

BACKGROUND OF THE INVENTION

1. Field of the Invention

The present invention relates to a self-cleaning domestic oven and, more particularly, to a control system for monitoring evolution of a cooking cycle and/or evolution and end of a cleaning cycle in a standard or pyrolytic oven.

The invention relates also to the use of an integrated sensor, placed in exhaust gas passage or into the cavity of the oven.

2. Description of the Related Art

It is known in the art to control a pyrolytic self-cleaning oven cycle by detecting the temperature by means of temperature sensing elements or probes disposed in the cavity of the oven. U.S. Pat. No. 4,852,544 discloses one of these known methods in which the probes are resistance temperature detectors using platinum probe elements exhibiting positive temperature coefficients. '544 discloses the use of a digital control system for receiving voltage input signals from the temperature sensors and for providing digital pulses or signals to the microprocessor of the control system.

With these known methods, which are based on a sensor that evaluates electrical conductivity of a probe element, the control system can control the cooking and/or self cleaning cycle on temperature data only, without any real feedback signal as far as the cooking process or pyrolytic self-cleaning process are concerned. In the self-cleaning process the control system can only fix temperature and time limit without any input in term of actual development of self-cleaning process. As a result, current ovens having a self-cleaning function maintain the oven cavity at high temperatures for a longer time than the real needed time, with obvious drawbacks in term of energy. saving and enamel life.

GB 2,325,299 discloses a pyrolytic self-cleaning oven having a sensor arranged to sense temperature in the vicinity of the catalyst to control heating during the self-cleaning cycle, which comprises a porous plug of ceramic material coated with a catalytic precious metal layer forming an oxidation catalyst.

SUMMARY OF THE INVENTION

According to the invention, a catalyst is supported on a conductive wire, which can be in the form of a plurality of wires arranged in a net like structure or element. The conductive wire or element can be heated by connecting it to a power supply without the need of a separate heater. The catalyst has the function of a sensor as well as a catalyst in the same device which is very easy to monitor. The oven can efficiently control the cooking process and/or the self-cleaning process by evaluating, in a simple way, certain chemical reactions, typical of the environment inside the oven cavity during cooking and/or self-cleaning pyrolytic processes, that take place on the surface of the catalyst. Even if all chemical reactions that occur during cooking are not well defined, it is known that foods under cooking release partially oxidised gases. Also, it is well known that during the self-cleaning pyrolytic process the partial combustion of soil on the surfaces of oven generates carbon monoxide as one of the reaction products. By placing a catalyst having a suitable operating temperature inside the oven or in the exhaust gas passage of the oven the applicant has discovered a way to control not only the actual conditions in the pyrolytic self-cleaning process, but also the cooking process.

The catalyst can be an oxide of platinum (Pt) or palladium (Pd) on a ceramic support in the form of a coating on a conductive, preferably metallic, wire. The catalytic element may be used as a probe for measuring electrical conductivity and therefore temperature of the catalyst. Also other catalysts which are involved in the process of oxidizing carbon monoxide or other more complex gases can be used, for instance a catalyst based on silver oxide or the like. The platinum catalyst can be used for coating a conductor or a net like structure of conductors capable of withstanding temperature of more than 500° C. and with wide variation of resistivity with temperature. The material for the conductor can be selected in the group of ferritic alloys (for example FeCrAlloy), austenitic alloys (for example NiCrFe alloys, ICONEL 600 series) and ceramic alloys (for example Cermet, Molybdenum Desilicides MoSi2, Kanthal Super). The catalytic coating on the wires or of the net-shaped element can be carried out according to known methods, for instance by applying a ceramic wash coat to a metal wire or by thermal spraying the wire element with a porous ceramic layer which is surfaced enlarged and then by applying the catalytically active material to the ceramic layer.

The catalytic wire or element may be placed in the exhaust gas passage of the oven or inside the cavity of the oven.

In the case the catalyst is used in conjunction with the pyrolytic cleaning of the oven when the cavity of the oven contains a certain amount of soil, over a certain temperature soil start to modify due to Maillard reaction producing gaseous components including CO, hydrocarbons and other volatile components. Those skilled in the art will recognise the Maillard reaction as a well known nonenzymatic reaction browning of foods in the cooking process. These components typically flow out of an oven through an exhaust gas passage, and so pass through the catalyst. When the catalytic material coating on the conductors is at a sufficiently high temperature, a chemical reaction occurs that transforms CO into carbon dioxide, as well as catalytic oxidation of other components, in an exothermic reaction. As a consequence, the temperature of the catalytic material, and accordingly the temperature of the underlying conductor, increases and the resistance of the conductor changes in response to the temperature change. By monitoring this change of resistance or by monitoring power consumption if the catalyst is heated for its activation, the control system of the oven can detect a signal that is a measurement of the concentration of certain components of the exhaust gas in the passage and thus, indirectly, of the stage of the cooking or of the amount of soil remaining inside the cavity in the pyrolytic self-cleaning cycle. The change of catalyst temperature is very rapid in case of even small changes of CO concentration in the oven or in the exhaust gases. When the change of CO concentration is around 100 ppm, the catalyst temperature has a dramatic change, and this sensitiveness is the reason why a control system according to the invention is very reliable and accurate.

In the case of pyrolytic cleaning of the oven, when cavity temperature reaches the desired value (around 470° C.) and the temperature of the catalyst stabilizes at a value dependent only on the cavity ambient temperature, the cavity will be clean. Resistance to be monitored can be of one or more wires of the catalytic element. The catalytic wire or element can be of the passive type (activated only by external temperature) or active (activated by temperature generated from resistance heating due to current flowing into the wires of the element).

In a further embodiment several layers of net-shaped catalytic elements can be used in order to increase the efficiency of oxidation of CO and other exhaust gases. Moreover the use of a plurality of layers can allow controlling the temperature pattern through the catalyst, such monitoring giving useful information to the electronic controller as far as the stages of cooking or of the pyrolytic self-cleaning cycle are concerned.

In a different embodiment two sensing wires of the same length are used, one with a catalytic coating and the other without coating. In this case the difference in resistance will give an indication of the make up or components of exhaust gas present in the exhaust passage and, as a consequence, the status of cooking in the oven or of the amount of soil remaining in the cavity in a self-cleaning cycle.

DESCRIPTION OF THE INVENTION

Figure 3:
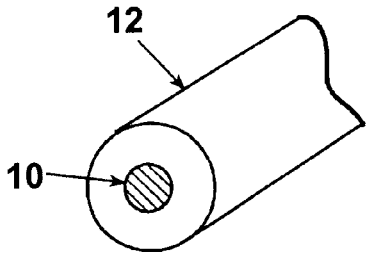
FIG. 3 is a schematic view of a wire coated with a catalytic layer as used in the present invention.

Referring now to the figures of the drawing, a domestic oven 1 is provided with a usual electrical heater 3 inside its cavity 5. Alternately, a gas burner could be used as the heating source for cooking and pyrolytic self-cleaning. The oven is further provided with an exhaust gas passage 7 in which a catalytic element 9 is placed. According to the invention, the element 9 is made of metal wires 10 coated with a catalytic composition 12 of platinum supported on ceramic material (FIG. 3). At least one of the wires 10 of the element 9 is connected to a circuit for measuring the electrical resistance of the wire. As will be readily understood by one skilled in he art, the circuit may for example comprise a bridge configuration with an operational amplifier.

Figure 4:
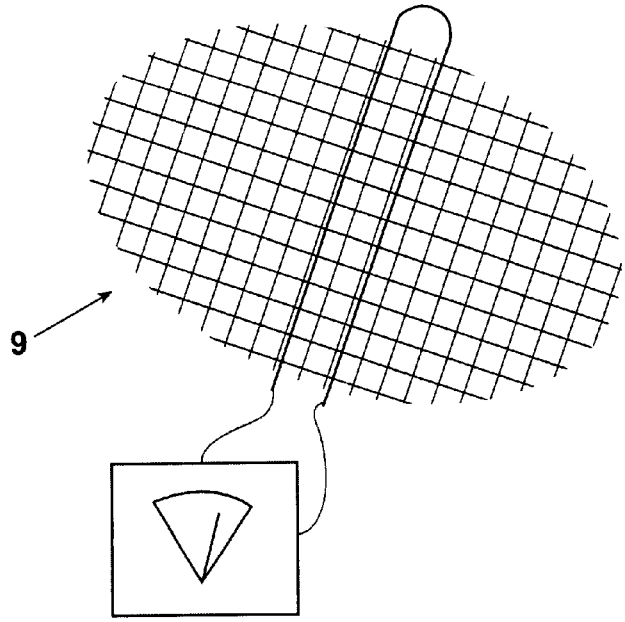
FIG. 4 is a perspective schematic view of a catalytic element according to a second embodiment.
Figure 5:
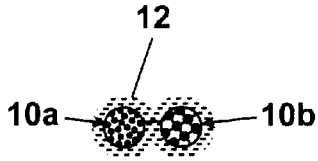
FIG. 5 is a cross section view of a wire used in the catalytic element of FIG. 4.

In FIG. 4 an embodiment similar to the previous one is disclosed, in which the element 9 is made of metal wires 10*a* coated with a catalytic composition 12 and in which at least one of such wire 10*a* is provided with a parallel wire-shaped probe 10*b* made from a metal having a high temperature coefficient. As it is shown in FIG. 5 the wire 10*a* and the sensing wire 10*b* may constitute a single element thanks to the coating of catalytic material 12 which embeds the two wires 10*a* and 10*b*.

According to the above embodiments, the control circuit of the oven senses the change of resistance of the wires 10 or 10*b* due to a change of temperature. Such change of temperature is not only due, as in previous ovens, to change of temperature of air/gases inside the oven, but it is also due to the catalytic reaction fostered by the catalytic coating 12 on the wires or element. It is then possible to control either the cooking process or the pyrolytic cleaning process inside the oven by monitoring the chemical reactions developing on the surface of the catalytic coating 12 (for instance combustion of hydrocarbons or other organic compounds in gaseous form or oxidation of carbon monoxide to carbon dioxide) by monitoring the temperature of the catalytic coating 12 by monitoring the resistance of the wires 10 or 10*b*.

The applicant has tested an oven provided with a catalytic element according to the invention, in which the wires (made of austenitic alloy based on nickel and iron, with a diameter of about 0.12 mm and a resistance at 20° C. of about 18.6 Ω/m) were coated with a ceramic composition having dispersed therein platinum with a concentration of 0.75 mole/l. The ceramic material can be zirconia, alumina, silica, tungsten carbides, titanium dioxide, silicon nitrides and mixtures thereof. The surface area of the porous ceramic layer is enlarged by means of known techniques such as the sol-gel technique or in-situ precipitation. In a pyrolytic cleaning cycle, without increasing the power input to the oven and after a stabilization period, the applicant has measured a change of temperature of the catalytic wire or element due to the chemical reaction. When the temperature reaches a steady value, this meant that the pyrolytic cycle was finished. The resistance of the sensing wire at 400° C. was about 52.452Ω and resistance at 500° C. was about 63.24Ω.

The applicant experienced a practically linear dependence of resistance from temperature. A raise in temperature of about 1° C. due to catalytic reaction has caused a change of resistance of (63.24–52.452)/100=0.108Ω.

Figure 1:
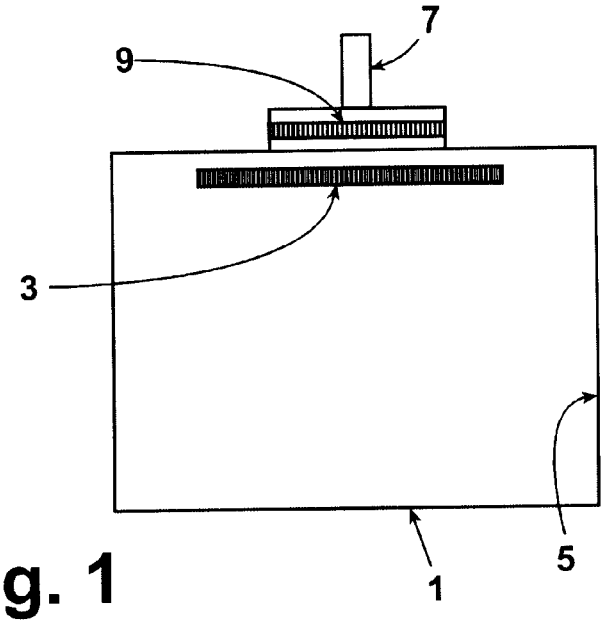
FIG. 1 is a schematic view of an oven provided with a control system according to the invention.
Figure 2:
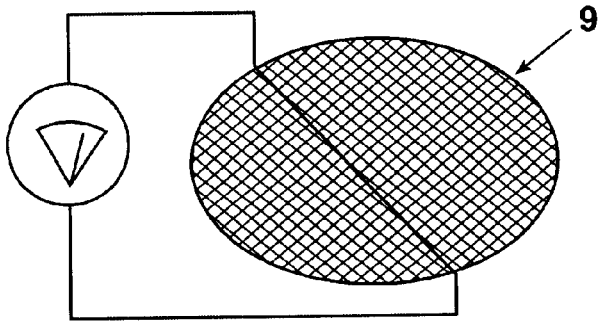
FIG. 2 is a perspective schematic view of a catalytic element used in the oven of FIG. 1 according to a first embodiment of the invention.
Figure 6:
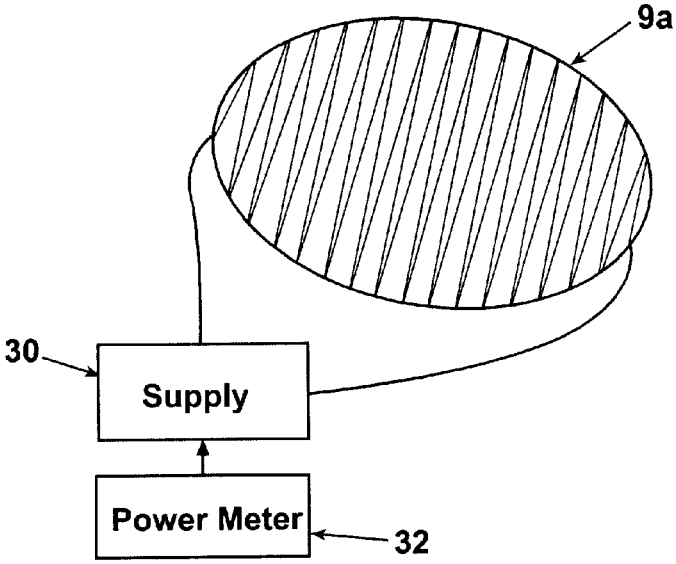
FIG. 6 is a perspective schematic view of a catalytic element according to a third embodiment.
Figure 7:
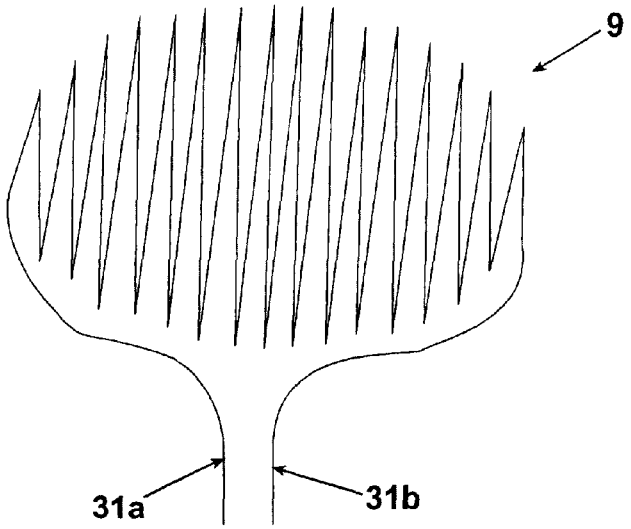
FIG. 7 is a top view of the element of FIG. 6.

In FIGS. 6 and 7 a further embodiment is shown, in which the catalytic element 9*a* is used as a resistance heating element whose ends 31*a* and 31*b* are linked to an electric power supply system 30 and to a power meter system 32. In this embodiment the electrical power is supplied to the catalytic element and the power consumed by the element depends on the temperature of the catalytic coated wire and therefore, as in the previous embodiment, on the chemical reaction of gases in the oven or exhaust ambient on the surface of the catalyst 12. This embodiment has the advantage that the catalytic element can more quickly reach the suitable temperature for the reaction and that it is more efficient at low temperatures. The catalytic element configuration of FIG. 6 can be also used according to the above embodiments (FIG. 2 or FIG. 4) in which the element or a wire thereof is not connected to a power supply.

Figure 8:
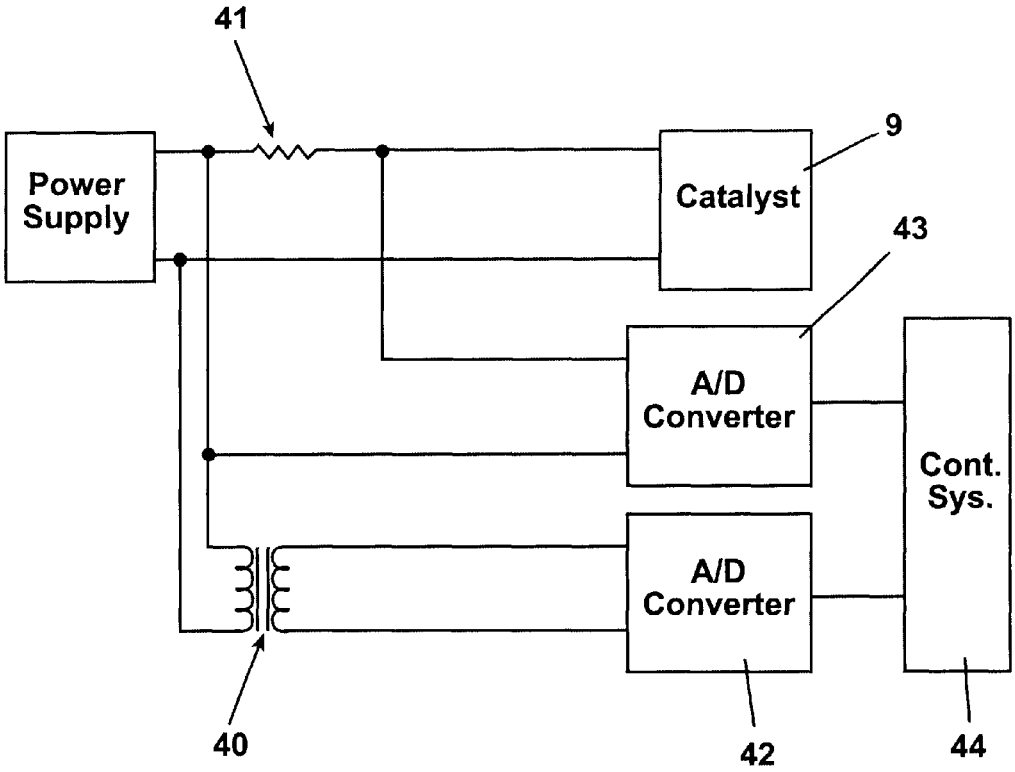
FIG. 8 is a block circuit diagram of the control system according to the embodiment of FIGS. 6 and 7.

The block diagram of FIG. 8 comprises a transformer 40, a reference resistance 41 and two A/D converters 42, 43 that read the value of the supply voltage and the voltage across the resistance 41 respectively, the latter value being correlated to the current flowing through the catalytic element 9. The control system 44 uses the value coming from A/D converters 42 and 43 for calculating the electrical power consumption of the catalytic element 9.

In a further embodiment (not shown in the drawings), more than one catalytic element is used. In the case of several catalytic elements stacked together, it is possible to sense the temperature of the catalyst at different levels or locations in the oven, therefore monitoring the evolution of the reactions on the catalytic element resulting from cooking or pyrolytic self-cleaning processes inside the oven.

The principle of using a wire coated with a catalytic composition is not limited to the use in an element placed in exhaust gas passage of the oven, but it applies also to a catalytic wire or element placed in the oven cavity and to a pair of wires as well, one coated with a catalytic composition and the other without a catalytic coating.

We claim:

1. A domestic oven comprising an oven cavity adapted to receive items to be cooked by said oven, heating means within said oven cavity for raising the temperature of said oven cavity, a control system for controlling the operation of said oven including said heating means, and a catalytic composition supported on a conductive wire positioned to complete the combustion and/or the oxidation of gases produced by a process carried out inside the oven and electrically connected to said control system for controlling said process.

2. A domestic oven comprising an oven cavity adapted to receive items to be cooked by said oven, an exhaust gas passage connected to said oven cavity, heating means within said oven cavity for raising the temperature of said oven cavity, a control system for controlling the operation of said oven including said heating means, and a catalytic composition supported on a conductive wire positioned inside said oven cavity or in said exhaust passage to complete the combustion and/or the oxidation of gases produced by a process carried out inside the oven and electrically connected to said control system for controlling said process.

3. A domestic oven according to claim 1 or 2, wherein said control system evaluates the resistance of said conductive wire for controlling said process.

4. A domestic oven according to claim 2, wherein said control system supplies electrical power to said conductive wire and evaluates the power absorbed by said wire for controlling said process.

5. A domestic oven according to claim 2, wherein said conductive wire is included in a plurality of wires forming a net-shaped catalytic element placed in said exhaust gas passage.

6. A domestic oven according to claim 5, wherein said catalytic element comprises a plurality of stacked net-shaped catalytic structures.

7. A domestic oven according to any of claim 1 or 2, wherein said conductive wire is placed inside the oven cavity and said control system evaluates the resistance of said conductive wire for controlling the cooking process of said oven.

8. A domestic oven according to claim 1 or 2, wherein said conductive wire is supported by a supporting wire, and both wires are coupled through the catalytic composition on said wires.

9. A domestic oven according to claim 1 or 2, wherein said catalytic composition is a platinum oxide supported by a ceramic material on said conductive wire.

10. A domestic oven according to claim 1 or 2, wherein said conductive wire is made of austenitic alloy based on Ni and Fe and has a temperature coefficient higher than 0.108Ω/° C.

11. A domestic oven comprising an oven cavity adapted to receive items to be cooked by said oven, an exhaust gas passage connected to said oven cavity, heating means within said oven cavity for raising the temperature of said oven cavity, a control system for controlling the operation of said oven including said heating means, a catalytic element comprising a catalytic composition supported on a conductive wire and positioned in said exhaust passage to complete the combustion and/or the oxidation of gases produced in the self-cleaning process carried out inside the oven, and circuit means connecting said catalytic element and said control system whereby said control system evaluates the resistance of said conductive wire for controlling said self-cleaning process.

12. An oven according to claim 11, wherein said catalytic element comprises a plurality of wires forming a net-shaped structure.

13. An oven according to claim 11, wherein said control system supplies electrical power to said catalytic element and evaluates the power absorbed by said catalytic element for controlling said self-cleaning process.

14. An oven according to claim 11, wherein said catalytic composition is a platinum oxide supported by a ceramic material on said conductive wire.

15. A domestic oven according to claim 11, wherein said conductive wire is supported by a supporting wire, and both wires are coupled through the catalytic composition on said wires.

16. An oven according to claim 11, wherein said conductive wire is made of austenitic alloy based on Ni and Fe and has a temperature coefficient higher than 0.108Ω/° C.

17. A domestic oven according to claim 11, wherein said catalytic element comprises a plurality of stacked net-shaped catalytic structures.

18. An oven comprising an oven cavity adapted to receive items to be cooked by said oven, heating means within said oven cavity for raising the temperature of said oven cavity, a control system for controlling the operation of said oven including said heating means, a catalytic element comprising a catalytic composition supported on a conductive wire and positioned in said oven cavity to oxidize of gases produced in the cooking process carried out inside the oven, and circuit means connecting said catalytic element and said control system whereby said control system evaluates the resistance of said conductive wire for controlling said cooking process.

19. An oven according to claim 18, wherein said catalytic composition is a platinum oxide supported by a ceramic material on said conductive wire.

20. A domestic oven according to claim 18, wherein said conductive wire is supported by a supporting wire, and both wires are coupled through the catalytic composition on said wires.

* * * * *